US005529895A

United States Patent [19]

Ihama

[11] Patent Number: 5,529,895

[45] Date of Patent: Jun. 25, 1996

[54] SILVER HALIDE PHOTOGRAPHIC EMULSION, METHOD OF PRODUCING THE SAME, AND LIGHT-SENSITIVE MATERIAL USING THE SAME

[75] Inventor: Mikio Ihama, Minami-ashigara, Japan

[73] Assignee: Fuji Photo Film Co., Ltd., Kanagawa, Japan

[21] Appl. No.: 388,447

[22] Filed: Feb. 14, 1995

Related U.S. Application Data

[62] Division of Ser. No. 246,826, May 20, 1994, abandoned.

[30] Foreign Application Priority Data

May 20, 1993 [JP] Japan ..... 5-139870

[51] Int. Cl.$^6$ ..... G03C 1/015

[52] U.S. Cl. ..... 430/569; 430/567

[58] Field of Search ..... 430/567, 569

[56] References Cited

U.S. PATENT DOCUMENTS 5,262,294 11/1993 Yagi et al. ..... 430/567

5,273,871 12/1993 Takada et al. ..... 430/567

5,298,383 3/1994 Mihayashi et al. ..... 430/557

*Primary Examiner*—Janet C. Baxter

*Attorney, Agent, or Firm*—Sughrue, Mion, Zinn, Macpeak & Seas

[57] ABSTRACT

A silver halide photographic emulsion contains tabular grains each having a silver iodide content of 5 to 20 mol %, and having an aspect ratio of 2 or more in an amount of 50% or more of a total projected area of all grains, wherein the relative standard deviation of the distribution of the silver iodide content between the grains, is 8% or less. A multiple color photographic light-sensitive material contains the above emulsion in its highest-speed blue-sensitive layer. The method of preparing the emulsion includes a step of growing a silver iodide containing-area having a silver iodide content of 6 to 30 mol % in an amount of 50% or more of all silver amount under a condition of pBr of 0 to 3.0 by means of double jet method using an aqueous silver salt solution containing 1.0 to 10.0 mol/l of silver salt and an aqueous halide solution containing 0.01 to 0.1 mol/l of iodide.

2 Claims, No Drawings

SILVER HALIDE PHOTOGRAPHIC EMULSION, METHOD OF PRODUCING THE SAME, AND LIGHT-SENSITIVE MATERIAL USING THE SAME

This is a divisional of application Ser. No. 08/246,826 filed May 20, 1994, now abandoned.

BACKGROUND OF THE INVENTION

1. Field of the Invention

The present invention relates to a tabular silver halide photographic emulsion having a silver iodide content of 5 mol % or more, and containing tabular grains having an aspect ratio of 2 or more in an amount of 50% or more of the total projected area of all grains, a method of preparing the emulsion, and a multilayer color photographic light-sensitive material using the emulsion.

2. Description of the Related Art

A method of producing a tabular silver halide photographic emulsion is discussed in detail in, for example, U.S. Pat. No. 4,945,037. The process of grain formation usually consists of a nucleation step, a ripening step, and a growing step. In the process, various techniques are used to control the grain size distribution. However, this document makes no mention of the concentration of iodide in an aqueous halide solution and the concentration of silver salt in an aqueous silver salt solution, added in the growing step, can effect on the distribution of the iodide content between grains.

JP-A-58-113928 ("JP-A" means Published Unexamined Japanese Patent Application) discloses a method of preparing a tabular silver bromoiodide emulsion having an average aspect ratio of 8 or more. However, this document merely states that the concentration of the halide salt added is preferably 0.1 to 5 mol/liter, and does not at all discuss the effect on the distribution of the iodide content between grains that is obtainable with the concentration of iodide in the aqueous halide solution or that of silver salt in the aqueous silver salt solution.

On the other hand, U.S. Pat. No. 4,835,095 discloses an internally silver iodide-rich, tabular silver halide emulsion having an aspect ratio of 5 or more, and having a relative standard deviation of silver iodide content distribution between grains of 20% or less. However, the minimum relative standard deviation of silver iodide content between grains in its Examples is 10%, and makes no mention of the concentration of iodide in the aqueous silver halide solution, or that of silver salt in the aqueous silver salt solution, added.

The present invention is to provide a method in which the relative standard deviation of the silver iodide content distribution is reduced to 8% or less, with clarification of the effect obtainable with the concentration of iodide in the aqueous halide solution added and that of silver salt in the aqueous silver salt solution, added.

SUMMARY OF THE INVENTION

An object of the present invention is to provide a tabular silver halide photographic emulsion having a silver iodide content of 5 mol % or more, and containing tabular grains having an aspect ratio of 2 or more in an amount of 50% or more of the total projected area of all grains, wherein the relative standard deviation of the distribution of the silver iodide content between grains is decreased to less than 10%.

Another object of the invention is to prepare a silver halide photographic emulsion having more excellent photographic properties, such as sensitivity/graininess ratio, fog and sensitivity.

The above objects are achieved by:

(1) A silver halide photographic emulsion comprising tabular grains each having a silver iodide content of 5 to 20 mol %, and having an aspect ratio of 2 or more in an amount of 50% or more of a total projected area of all grains, wherein the relative standard deviation of the distribution of the silver iodide content between the grains, is 8% or less.

(2) A silver halide photographic emulsion comprising tabular grains each having a silver iodide content of 8 to 15 mol %, and having an aspect ratio of 4 or more in an amount of 50% or more of a total projected area of all grains, wherein the relative standard deviation of the distribution of the silver iodide content between the grains, is 6% or less.

(3) A method of preparing a silver halide photographic emulsion comprising tabular grains each having a silver iodide content of 5 to 20 mol %, and having an aspect ratio of 2 or more in an amount of 50% or more of a total projected area of all grains, wherein the method including a step of growing a silver iodide containing-area having a silver iodide content of 6 to 30 mol % in an amount of 50% or more of all silver amount under a condition of pBr of 0 to 3.0 by means of a double jet method using an aqueous silver salt solution containing 1.0 to 10.0 mol/l of silver salt and an aqueous halide solution containing 0.01 to 0.1 mol/l of iodide.

(4) A method of preparing a silver halide photographic emulsion comprising tabular grains each having a silver iodide content of 8 to 15 mol %, and having an aspect ratio of 4 or more in an amount of 50% or more of a total projected area of all grains, the method including a step of growing a silver iodide containing-area having a silver iodide content of 9 to 30 mol % in an amount of 50% or more of all silver amount under a condition of pBr of 0 to 2.3 by means of double jet method using an aqueous silver salt solution containing 1.5 to 5 mol/l of silver salt and an aqueous halide solution containing 0.01 to 0.075 mol/l of iodide.

(5) A multilayer color photographic light-sensitive material comprising a highest-speed blue-sensitive layer containing a silver halide photographic emulsion comprising tabular grains having a relative standard deviation of the silver iodide content distribution, between grains, of 8% or less; each having a silver iodide content of 8 mol % or more; and having an aspect ratio of 3 or more in an amount of 50% or more of a total projected area of all grains.

DETAILED DESCRIPTION OF THE PREFERRED EMBODIMENTS

The preparation process of the silver halide photographic emulsion according to the present invention, comprises at least a nucleation step, a ripening step and a growing step. These steps are generally described in detail in U.S. Pat. No. 4,945,037. The ripening and growing steps may be repeatedly carried out in an arbitrary order.

In the growing step, the aqueous silver salt solution and the aqueous halide solution are added to a mixing vessel by means of the double jet method. The mixing vessel is preferably of a type that enables each solution to add into the solution that already exists in the mixing vessel, and examples thereof are disclosed in, for example, U.S. Pat. No. 3,785,777 and West German Patent No. 2,556,888. The aqueous silver salt solution is prepared by dissolving soluble silver salt, a typical example of which is silver nitrate, into water. In the present invention, the concentration of the silver salt is preferably 1.0 to 10 mol/l, more preferably 1.5 to 5 mol/l. To the aqueous silver salt solution, a dispersing medium such as gelatin, an inorganic salt such as ammonium nitrate, a multivalent metal salt such as iridium ammonium chloride, a pH adjusting agent or the like may be added. The silver salt solution can be maintained at an arbitrary temperature, preferably in a range from 20° C. to 80° C.

The halide solution is prepared by dissolving a soluble iodide salt, typical example of which is potassium iodide and a soluble bromide salt, a typical example of which is potassium bromide, and/or a soluble chloride salt, typical example of which is sodium chloride, into water at given ratios, respectively. The concentration of the bromide salt is preferably 10 mol/l or less, more preferably 2.5 mol/l or less. In the case where the halide solution contains the chloride salt, the concentration thereof is preferably 2 mol/l or less.

One of the feature of the present invention is based on the concentration of iodide in the aqueous halide solution in the step for growing the silver bromoiodide containing-area having a silver iodide content of 6 mol % or more. In order to grow the silver bromoiodide containing-area having a silver iodide content less than 6 mol %, the condition that the concentration of iodide in the aqueous halide solution is 0.1 mol/l or less, is usually imposed. However, to grow the silver bromoiodide containing-area having a silver iodide content of 6 mol % or more, the concentration of iodide in the aqueous halide solution should had-been much higher than 0.1 mol/l. The effect of the present invention can be obtained by setting the concentration of iodide in the aqueous halide solution to 0.1 mol/l or less and preferably 0.01 mol/l or more in the step of growing the silver bromoiodide containing area having a silver iodide content of 6 mol % or more. More preferably, the effect of the invention will be more remarkable if the concentration of iodide of the aqueous silver halide solution in the step is set 0.075 mol/l or less and 0.01 mol/l or more. The aqueous halide solution may contain bromide salt and/or chloride salt having the above-specified concentrations, respectively in one solution, or an aqueous bromide salt solution and/or an aqueous chloride salt solution may be prepared separately as individual solutions. To the halide solution, dispersing medium such as gelatin, an inorganic salt such as ammonium nitrate, a multivalent metal salt such as iridium ammonium chloride, a pH adjusting agent or the like may be added. The aqueous halide solution can be maintained at an arbitrary temperature, preferably in a range from 20° C. to 80° C.

The aqueous silver salt solution and the aqueous halide solution are added at the same time or at staggered times by the double jet method. When there are more than one aqueous halide solutions and/or more than one aqueous silver salt solutions, these solutions may be added by a multi-jet method.

The process for growing the silver bromoiodide containing area having a silver iodide content of 6 mol % or more by using the aqueous silver salt solution having the silver salt concentration of 1.0 mol/l or more and the aqueous halide solution having the iodide concentration of 0.1 mol/l or less is carried out at pBr of 3 or less, preferably pBr of 2.3 or less and 0 or more. The effect of the present invention is exhibited when the silver iodide content of silver halide formed in this step is 6 mol % or more, preferably 9 mol % or more for a more remarkable effect. The upper limit of the silver iodide content is preferably 30 mol % or less. Further, in this step, a silver iodide containing area having a silver iodide content of 6 to 30 mol % is preferably grown in an amount of 50% or more of all the silver amount in each of the tabular grains, so as to exhibit a remarkable effect of the invention, or in an amount of 60% or more of all the silver amount in each of the tabular grains, as being most preferable.

The present invention relates to a silver halide photographic emulsion occupied by tabular grains each having a silver iodide content of 5 mol % or more, having an aspect ratio of 2 or more in an amount of 50% or more of a total projected area of all grains. The silver iodide content can be easily calculated from the administered amounts. The silver iodide content is preferably 8 mol % or more and 20 mol % or less, and more preferably 8 mol % or more and 15 mol % or less.

The emulsion of the present invention is occupied by tabular silver halide grains having an aspect ratio of 2 or more, preferably 3 or more, and more preferably, 4 or more. The upper limit of the aspect ratio is preferably 20 or less. When silver halide grains having the aspect ratio of the above-specified range are used, the effect of the invention is most remarkably exhibited, and the best sensitivity/graininess ratio can be obtained. The "tabular grain" is a general term for a grain having one twined crystal face or two or more parallel twined crystal faces. The "twined crystal face" means a (111) face of the case where the ions located at all lattice points have a mirror-image relationship between both sides of the (111) face. The tabular grain has, when viewed from the top thereof, a triangular shape, hexagonal shape, or circular shapes which are obtained by rounding the corners of the mentioned shapes, respectively. The triangular-shaped grain has parallel triangular external surfaces, and accordingly, the hexagonal-shaped and the circular-shaped grains have parallel hexagonal and circular external surfaces, respectively.

In the present invention, the aspect ratio of tabular grains is defined by a value obtained by dividing the diameter of each grain which has a diameter of 0.1 μm or more, by the thickness thereof. The thickness of each grain can be easily obtained by the following manner. That is, metal is deposited from a diagonal direction on a grain as well as latex used for reference, and the length of shadow thereof on an electron microscopic photograph is measured. The thickness of the grain can be calculated with reference to the length of the shadow of the latex.

The grain diameter in the present invention is defined by the diameter of a circle having the same area as the projected area of the parallel external surfaces of the grain.

The projected area of a grain can be obtained by measuring the area of the grain on an electron microscopic photograph, and calculating the area with consideration of the magnification.

The diameter of each of the tabular grains is preferably 0.15 to 5.0 μm, and the thickness thereof is preferably 0.05 to 1.0 μm.

The grain in the emulsion of the present invention is occupied by the tabular grains having an aspect ratio of 2 or more, preferably 3 or more, in an amount of 50% or more of the total projected area of all grains.

The ratio occupied by the tabular grains is preferably 60% or more of the total projected area of all grains, and more preferably 80% or more.

In some cases, even a better result can be observed when monodisperse tabular grains are used. The structure and the preparation method of monodisperse tabular grains can be referred to the description for example, JP-A-63-151618. Briefly, the monodisperse tabular grains have a hexagonal shape having a ratio, longest side to shortest side, of 2 or less, in amount of 70% or more of a total projected area of all grains, and consist of tabular silver halide having two parallel planes as the external surfaces. Further, these grains have a variation coefficient of 20% or less in terms of the size distribution of the hexagonal tabular silver halide grains. The variation coefficient is a value obtained by dividing a deviation (standard deviation) of grain sizes expressed in terms of equivalent-circle diameter of a projected area by an average grain size.

The emulsion of the present invention has a relative standard deviation of 8% or less in terms of silver iodide content distribution of the grains, preferably 6% or less. The relative standard deviation of the silver iodide content of the grains can be easily obtained by EPMA method (electron-probe micro analyzer method).

In this method, a sample emulsion in which grains are sufficiently dispersed so as not to be in contact with each other, is prepared, and an electron beam is irradiated thereon. The X-ray analytic technique by use of electron beam excitation, can be used for elementary analysis of a super fine portion. By use of this method, the halide composition of each grain can be determined from the characteristic X ray intensity of silver and iodine emitted from the grain whether or not an emulsion is of the present invention can be determined by checking the halide compositions of at least 100 sample grains from the emulsion, by the EPMA method.

The relative standard deviation of silver iodide content is a value obtained by dividing a standard deviation, the distribution of silver iodide content as for at least 100 sample grains, by an average silver iodide content, and multiplying it by 100.

The emulsion of the present invention can be used for any light-sensitive materials, but is preferably used for a multilayer color photographic light-sensitive material. The emulsion is more preferably used for blue-sensitive layers of a multilayer color photographic light-sensitive material, and is most preferably used for the highest-speed blue-sensitive light-sensitive layer of a multiple color photographic light-sensitive material. When the emulsion is used in the highest-speed blue-sensitive layer, the amount of absorption of blue light is increased because of a high silver iodide content, and also because of an increase in the amount of absorption of a sensitization dye, due to the tabular shape, thereby achieving a high sensitivity/granularity ratio. Further, since the silver iodide content distribution of the grains is lowered, a high sensitivity/granularity ratio, improved pressure resistance characteristics, improved storage aging characteristics and improved processing dependability are achieved. Further, scattering of light is reduced due to the tabular shape, thereby enhancing the sharpness of lower layer.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of 40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensiti- | pp. 23-24 | page 648, right | pp. 866- |

-continued

| Additives | RD17643 | RD18716 | RD307105 |
|---|---|---|---|
| zers, super-sensitizers | | column to page 649, right column | 868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-l-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples-of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl-)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness. The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are:

3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)anline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-( 4-hydroxybutyl)aniline, 4-amino-3-ethoxy-N,N-bis(5-hydroxypentyl)aniline, 4-amino-3-propyl-N-(4-hydroxybutyl)aniline, and the sulfates, hydrochlorides and p-toluenesulfonates thereof. Of these compounds, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(3-hydroxybutyl)aniline, and the sulfates, hydrochlorides and p-toluenesulfonates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8.0. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in west German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoanilinebased compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

The present invention will now be described in detail with reference to Examples. The invention is not limited to the Examples.

EXAMPLE 1

Example 1 is directed to the case where the silver bromoiodide phase having a silver iodide content of 9.4 mol % are formed using silver bromide tabular grains as seed grains.

(Preparation of silver bromide tabular seed grain emulsion)

Silver bromide tabular seed grain emulsion were prepared in accordance with the manner described in JP-A-63-151618. The tabular grains had an average equivalent-circle diameter of 0.52 μm, a variation coefficient of the equivalent-circle diameter of 16.8%, an average thickness of 0.146 μm, a variation coefficient of the thickness of 16.9%, and an average aspect ratio of 3.7. After washing the grains with water, gelatin was added thereto, and then the mixture was adjusted at 40° C. to pH 6.2 and pAg 8.8. The emulsion thus prepared contains, per Kg, 140.0 g of Ag and 65.9 g of gelatin.

(Preparation of the silver bromoiodide tabular grain emulsion)

Em-A was prepared as follows.

1231 ml of an aqueous solution containing 5.29 g of KBr and 37.9 g of gelatin was stirred at 78° C. After 134 g of the silver bromide tabular seed grain emulsion prepared above was added to the solution, a reduction sensitizer was further added thereto. Then, silver bromoiodide phase having a silver iodide content of 9.4 mol % was formed by using the double jet method as follows. 1.89 mol/l of an aqueous silver nitrate solution that was prepared by dissolving 130.4 g of $AgNO_3$ into water to make the volume thereof to 404.8 ml, was further added thereto over a period of 64 minutes at an accelerated flow rate with the initial flow rate of 4.74 ml/min and the final flow rate of 6.52 ml/min. An aqueous halide solution that was prepared by dissolving. 99.6 g of KBr and 15.2 g of KI into $H_2O$ to make the total volume thereof 444 ml was added thereto simultaneously maintaining pBr at 1.85. The concentration of potassium iodide of the above aqueous halide solution corresponds to 0.206 mol/l. After pBr of the mixture was adjusted to 2.4, sodium benzenthiosulfonate was added to the mixture, and the temperature thereof was reduced to 50° C. After adding thereto an aqueous silver nitrate solution ($AgNO_3$ 7.1 g) and an aqueous potassium iodide solution (KI 5.3 g) by the double jet method, the mixture was adjusted to pBr of 1.85. After further adding an aqueous silver nitrate solution ($AgNO_3$ 66.4 g) and an aqueous potassium bromide solution (KBr 47.1 g) simultaneously by the double jet method, the mixture was cooled. After the mixture was washed with water, gelatin was added thereto, and the mixture was adjusted to pH of 5.8 and pAg of 8.8 at the temperature of 40° C. Em-B to Em-D were prepared in the same manner as Em-A, except that the halide solution having potassium iodide concentration of 0.206 mol/l was changed to 0.100 mol/l 0.0713 mol/l and 0.0516 mol/l, respectively.

(Distribution of grain size and silver iodide content between grains)

Em-A thus prepared was an emulsion occupied by silver bromoiodide tabular grains having an average equivalent-circle diameter of 1.21 μm, a variation coefficient of the diameter of 25.2%, an average thickness of 0.291 μm, an average aspect ratio of 4.34 and silver iodide content of 8.9 mol %.

As for each of Em-A, B, C and D, the concentration of silver nitrate of the aqueous silver nitrate solution and the concentration of potassium iodide of the aqueous halide solution that were used to prepare the silver bromoiodide phase containing 9.4 mol % of silver iodide, the variation coefficient of equivalent-circle diameter, and the relative standard deviation of the silver iodide content between grains, obtained by the EPMA method were listed in Table 1 below.

TABLE 1

| | Concentration of silver nitrate (mol/l) | Concentration of potassium iodide (mol/l) | Variation coefficient of equivalent circle diameter (%) | Relative standard deviation of silver iodide content between grains (%) |
|---|---|---|---|---|
| Em-A (Comparative example) | 1.89 | 0.206 | 25.2 | 9.76 |
| Em-B (Present invention) | 1.89 | 0.100 | 21.5 | 7.13 |
| Em-C (Present invention) | 1.89 | 0.0713 | 19.6 | 5.99 |
| Em-D (Present invention) | 1.89 | 0.0516 | 19.5 | 5.46 |

As is apparent from the results in Table 1, the effect on the distribution of silver iodide between grains obtained by the concentration of potassium iodide in the halide solution was very significant. That is, with a concentration of potassium iodide of 0.1 mol/l or less, the relative standard deviation of the silver iodide content between grains, could be reduced to 8% or less, and the distribution of grain size, expressed in the variation coefficient of equivalent-circle diameter, was also reduced.

It should be noted that the above-described effects were not obtained even if the number of stirring rotation times, or the like was changed. More specifically, as for Em-A, even if the efficiency of stirring and the like in the step of growing the silver bromoiodide phase having a silver iodide content of 9.4 mol % was increased, the effect of the present invention could not be obtained.

EXAMPLE 2

The case where the silver bromoiodide phase having a silver iodide content of 13.2 mol % was formed around silver bromide tabular grains that serve as seed grains, will now be described.

(Preparation of the silver bromoiodide tabular grain emulsion)

Em-E was prepared in the same manner as Em-A in Example 1, except that the amount of the silver bromide tabular core grain emulsion was changed to 67 g, and the aqueous halide solution used to form the silver bromoiodide phase containing 9.4 mol % of silver iodide was changed to the solution prepared by dissolving 95.2 g of KBr and 21.3 g of KI into water to make the total volume thereof 444 ml. The concentration of potassium iodide in the above aqueous halide solution corresponds to 0.289 mol/l. Em-F, G and H were prepared in the same manner as Em-E, except that the total volume of the aqueous halide solution containing 95.2 g of KBr and 21.3 g of KI was changed to 1,916 ml, 1,284 ml and 1,776 ml, respectively. The concentrations of silver iodide in the above halide solutions correspond to 0.140, 0.100 and 0.072 mol/l respectively.

(Distribution of grain size and silver iodide content between grains)

Em-E thus prepared was an emulsion occupied by silver bromoiodide tabular grains having an average equivalent-circle diameter of 1.45 μm, a variation coefficient of equivalent-circle diameter of 25.4%, an average thickness of 0.320 μm, an average aspect ratio of 4.81 and a silver iodide content of 11.4 mol %.

As for each of Em-E, F, G and H, the concentration of silver nitrate of the aqueous silver nitrate solution and the concentration of potassium iodide of the aqueous halide solution that were used to prepare the silver bromoiodide phase containing 13.2 mol % of silver iodide, the variation coefficient of equivalent-circle diameter, and the relative standard deviation of the silver iodide content between grains, obtained by the EPMA method were summarized in Table 2 below.

TABLE 2

| | Concentration of silver nitrate (mol/l) | Concentration of potassium iodide (mol/l) | Variation coefficient of equivalent circle diameter (%) | Relative standard deviation of silver iodide content between grains (%) |
|---|---|---|---|---|
| Em-E (Comparative example) | 1.89 | 0.289 | 25.4 | 9.89 |
| Em-F (Comparative example) | 1.89 | 0.140 | 23.7 | 9.01 |
| Em-G (Present invention) | 1.89 | 0.100 | 17.2 | 7.04 |
| Em-H (Present invention) | 1.89 | 0.072 | 15.3 | 5.61 |

As is apparent from the results in Table 2, the effect on the distribution of silver iodide between grains obtained by the concentration of potassium iodide in the halide solution was very significant, similar to that in Example 1. That is, with a concentration of potassium iodide of 0.1 mol/l or less, the relative standard deviation of the silver iodide content between grains, could be reduced to 8% or less, and the distribution of grain size, expressed in the variation coefficient of equivalent-circle diameter, was also reduced in great deal.

EXAMPLE 3

The photographic properties of the emulsions prepared by the method of the present invention will now be described.

(Chemical Sensitization)

Em-A and Em-D prepared in Example 1 were subjected to chemical sensitization. While maintaining the temperature of each emulsion at 60° C., $3\times10^{-7}$ mol/mol of Ag of potassium iridium (IV) chloride, $5.8\times10^{-4}$ mol/mol of Ag of the sensitization dye D-1 specified below, $1.6\times10^{-3}$ mol/mol of Ag of potassium thiocyanate, $2.45\times10^{-6}$ mol/mol of Ag of chloroauric acid, $7.99\times10^{-6}$ mol/mol of Ag of sodium thiosulfate, and $3.81\times10^{-6}$ mol/mol of Ag of N,N-dimethylselenourea were added to each emulsion, and then each of the emulsions was ripened for 40 to 60 minutes. After $2.5\times10^{-4}$ mol/mol Of Ag of compound FF-1 specified below was added to each emulsion and then each of the emulsions was cooled.

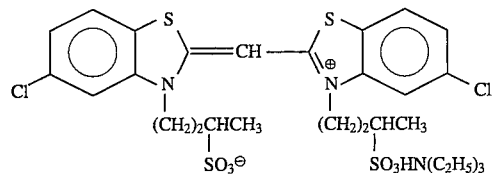

D-1

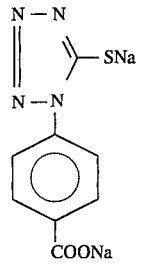

FF-1

(Coating and development)

The emulsion layer containing the emulsion that was chemically sensitized as described above and the protective layer, having compositions specified below, were coated on a heat-processed polyester film support (consisting mainly of benzenedicarboxylic acid, naphthalenedicarboxylic acid and ethyleneglycol) provided with a subbing layer, thereby preparing samples No. 1 and No. 2.

(1) Emulsion layer (in terms of Ag 1.2 g/m²)
Emulsion Em-A or Em-D
Coupler

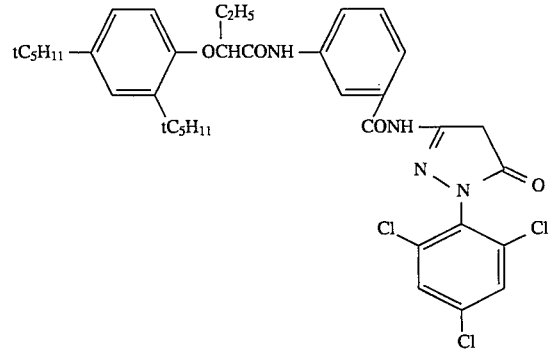

(1.5 × 10–3 mol/m²)

Tricresylphosphate (1.10 g/m²)

-continued

| | |
|---|---|
| Gelatin | (2.30 g/m$^2$) |
| (2) Protective layer | (0.08 g/m$^2$) |
| 2,4-dichloro-6-hydroxy-s-triazine sodium salt | |
| Gelatin | (1.80 g/m$^2$) |
| Antifoggant | |
| 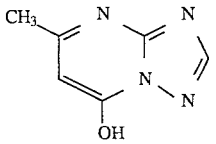 | (8.4 × 10$^{-5}$ mol/m$^2$) |

These samples were allowed to stand for 14 hours at a temperature of 40° C. and a relative humidity of 70%, and were exposed to light for 1/100 sec via gelatin filter SC39 manufactured by FUJI PHOTO FILM CO., and continuous wedges. Thereafter, the samples were subjected to the following color development process.

After the process, the density of each sample was measured through a green filter.

| | Processing Condition | |
|---|---|---|
| Step | Time | Temp. |
| Color development | 2 min | 40° C. |
| Bleach-fixing | 3 min | 40° C. |
| Water washing (1) | 20 sec | 35° C. |
| Water washing (2) | 20 sec | 35° C. |
| Stabilization | 20 sec | 35° C. |
| Drying | 50 sec | 65° C. |

The composition of the processing solutions are as follows:

| (Color Developing Solution) | (g) |
|---|---|
| Diethylenetriamine-pentaacetic acid | 2.0 |
| 1-hydroxyethylidene-1, 1-diphsophonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxyethylamino]-2-methylaniline sulfate | 4.5 |
| Water to make | 1.0 |
| pH | 10.05 |

| (Bleach-fixing Solution) | (g) |
|---|---|
| Ammonium Fe (III) ethylenediamine tetraacetate dihydrate | 90.0 |
| Disodium ethylenediamine tetraacetate | 5.0 |
| Sodium sulfite | 12.0 |
| Aqueous solution of Ammonium thiosulfate (70%) | 260.0 ml |
| Acetic acid (98%) | 5.0 ml |
| Breach promoter | |
| 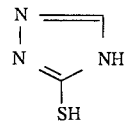 | 0.01 mol |
| Water to make | 1.0 l |
| pH | 6.0 |

(Water-washing solution)

Tap water was passed through a mixed-bed column filled with H-type strongly acidic cation-exchange resin (AMBERLITE IR-120B available from Rome and Harse, Co.) and OH-type anton exchange-resin (AMBERLITE IR-400), whereby the calcium and magnesium ion concentrations of the water were reduced to 3 mg/l or less, respectively. Further, 20 mg/l of sodium isocyanurate dichloride and 1.5 g/l of sodium sulfate were added to the water thus processed.

The washing solution had a pH value in a range of 3.5 to 7.5.

| (Stabilizing solution) | (g) |
|---|---|
| Formalin (37%) | 2.0 ml |
| Polyoxyethylene-p-monononylphenyl ether (average polymerization degree: 10) | 0.3 |
| Disodium ethylenediamine tetraacetate | 0.05 |
| Water to make | 1.0 liter |
| pH | 5.0–8.0 |

The photographic sensitivities of each sample were shown in the relative values of reciprocals of the exposure amounts (lux.sec) required to give the optical densities larger than fog by 0.2 and 1.3, respectively.

The results were shown in Table 3 below.

TABLE 3

| | | | Relative sensitivity | |
|---|---|---|---|---|
| Sample No. | Emulsion | Fog | fog + 0.2 | fog + 1.3 |
| No. 1 (Comparative example) | Em-A | 0.25 | 100 | 100 |
| No. 2 (Present invention) | Em-D | 0.19 | 107 | 126 |

As is apparent from the results in Table 3, the sample of the present invention exhibited a lower fog, a higher sensitivity and a higher contrast than the comparative example. Thus, the sample of the present invention had excellent photographic properties.

EXAMPLE 4

Each of the layers having compositions specified below was coated on a triacetylcellurose film substrate provided with a subbing layer, thereby preparing sample 101, which is a multilayer color light-sensitive material.

(Composition of Light-sensitive Layer)

Main compositions used in the layers can be categorized as follows:

ExC: a cyan coupler, UV: an ultraviolet ray absorber, ExM: a magenta coupler, HBS: a high-boiling organic solvent, ExY: a yellow-coupler, H: a gelatin hardening agent, ExS: a sensitization dye Each of numerals corresponding respectively to components indicates an amount of coating expressed in the unit of $g/m^2$, except that each of the amounts of coloidal silvers and silver halide emulsions were expressed in terms of silver amount in the unit of $g/m^2$ and each of the sensitizing dyes was expressed in the unit of mole per mole of silver halide present in the same layer.

(Sample 101)

| | |
|---|---|
| **Layer 1: Antihalation layer** | |
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| **Layer 2: Interlayer** | |
| Silver bromoiodide emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **Layer 3: Low-speed red-sensitive layer** | |
| Silver bromoiodide emulsion A | silver 0.25 |
| Silver bromoiodide emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| **Layer 4: Medium-speed red-sensitive emulsion layer** | |
| Silver bromoiodide emulsion D | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| **Layer 5: High-speed red-sensitive emulsion layer** | |
| Silver bromoiodide emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-B | 0.025 |
| Cpd-2 | 0.050 |
| HBS-1 | 0.22 |
| HBS-1 | 0.10 |
| Gelatin | 1.20 |
| **Layer 6: Interlayer** | |
| Cpd-1 | 0.10 |
| HBS-1 | 0.50 |

-continued

| | |
|---|---|
| Gelatin | 1.10 |
| **Layer 7: Low-speed green-sensitive emulsion layer** | |
| Silver bromoiodide emulsion C | silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| **Layer 8: Medium-speed green-sensitive emulsion layer** | |
| Silver bromoiodide emulsion D | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| **Layer 9: High-speed green-sensitive emulsion layer** | |
| Silver bromoiodide emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| **Layer 10: Yellow Filter Layer** | |
| Yellow colloidal silver | silver 0.030 |
| Cpd-1 | 0.16 |
| HBS-1 | 0.60 |
| Gelatin | 0.60 |
| **Layer 11: Low-speed blue-sensitive emulsion layer** | |
| Silver bromoiodide emulsion C | silver 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| **Layer 12: Medium-speed blue-sensitive emulsion layer** | |
| Silver bromoiodide emulsion D | silver 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| **Layer 13: High-speed blue-sensitive emulsion layer** | |
| Silver bromoiodide emulsion F | silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| **Layer 14: First protective layer** | |
| Silver bromoiodide emulsion G | silver 0.20 |
| UV-4 | 0.11 |
| UV-5 | 0.17 |
| HBS-1 | $5.0 \times 10^{-2}$ |

-continued

| | |
|---|---|
| Gelatin | 1.00 |
| Layer 15: Second protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, each layer contained W-1 to W-3, B-4 to B-6, F-1 to F-17, an iron salt, a lead salt, a gold salt, a platinum salt, an iridium salt, and a rhodium salt, in order to enhance the storability, processability, pressure-resistant property, anti-mildew and bacteria property, antistatic property and coat-ability, as the case might be.

The emulsions used were summarized in Table 4 below.

TABLE 4

| | Average AgI content (%) | Average grain diameter (μm) | Variation coefficient of grain diameter (%) | Average aspect ratio | Silver amount ratio [core/ inter-mediate/ Shell] | Silver amount ratio (AgI content (mol %)) | Grain structure/ shape |
|---|---|---|---|---|---|---|---|
| Emulsion | | | | | | | |
| A | 4.0 | 0.45 | 27 | 1 | [1/3] | (13/1) | structure octahedral grain |
| B | 8.9 | 0.07 | 14 | 1 | [3/7] | (25/2) | Double structure octahedral grain |
| C | 2.0 | 0.55 | 25 | 7 | — | | Uniform structure tabular grain |
| D | 9.0 | 0.65 | 25 | 6 | [12/59/29] | (0/11/8) | Triple structure tabular grain |
| E | 9.0 | 0.85 | 23 | 5 | [8/59/33] | (0/11/8) | Triple structure tabular grain |
| F | 14.5 | 1.25 | 25 | 3 | [37/63] | (34/3) | Double structure plate like grain |
| G | 1.0 | 0.07 | 15 | 1 | — | | Uniform structure fine grain |

In Table 4:

(1) Emulsions A to F were reduction-sensitized by using thioureadioxide and thiosulfonic acid in the same manner as in the Example of JP-A-2-191938.

(2) Emulsions A to F were gold-sensitized, sulfur-sensitized and selenium-sensitized in the presence of spectral sensitizing dye and sodium thiocyanate set forth in the description of each light-sensitive layer in the same manner as in the Example of JP-A-3-237450.

(3) In preparation of tabular grains, low-molecular weight gelatin was used in the same manner as in the Example of JP-A-1-158426.

(4) In tabular grains and regular crystal grains having grain structures, dislocation lines such as discussed in JP-A-3-237450 were observed under a high voltage electron microscope.

The compounds used were as follows:

ExC-1
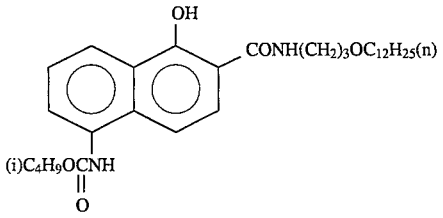
ExC-2
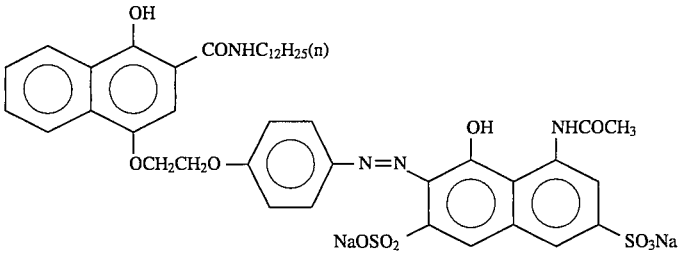
ExC-3
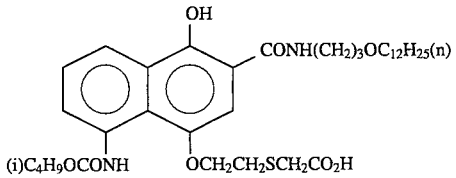
ExC-4
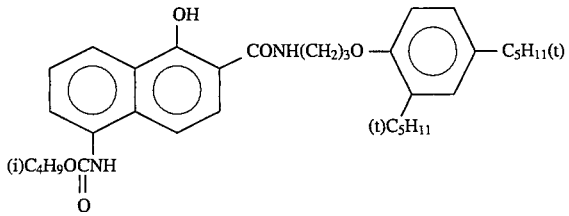
ExC-5
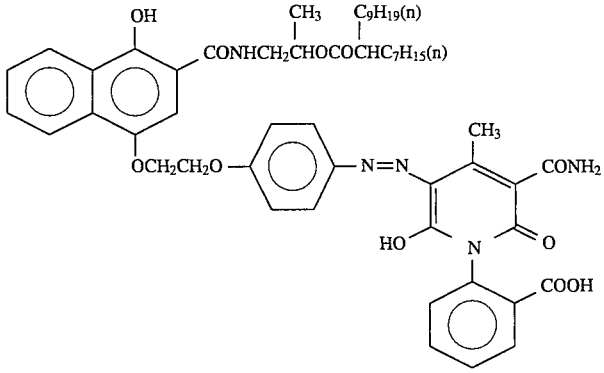
ExC-6
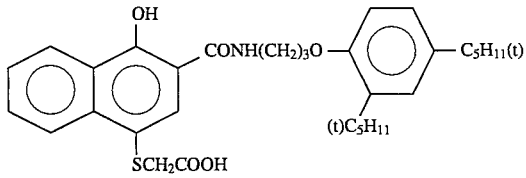

-continued
ExC-7
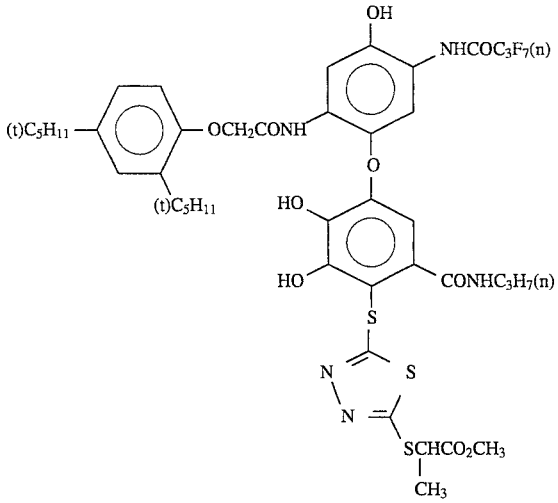
ExC-8
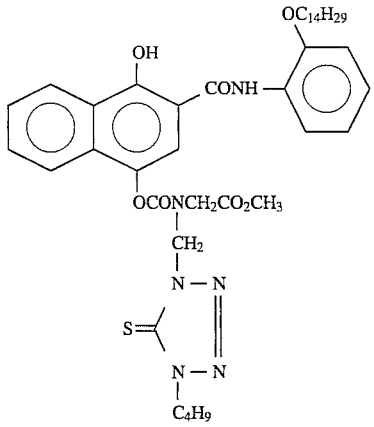
ExM-1
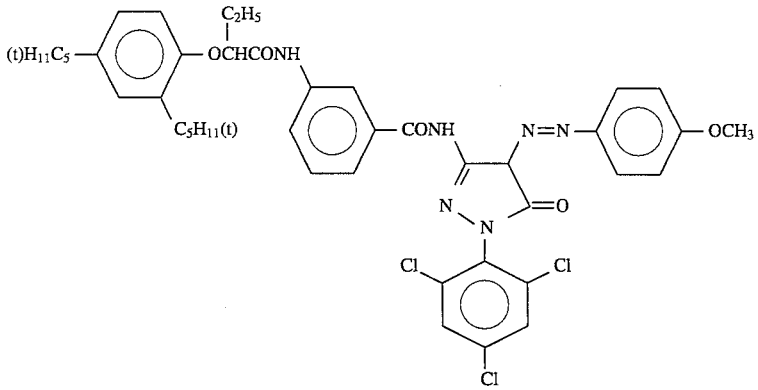
ExM-2
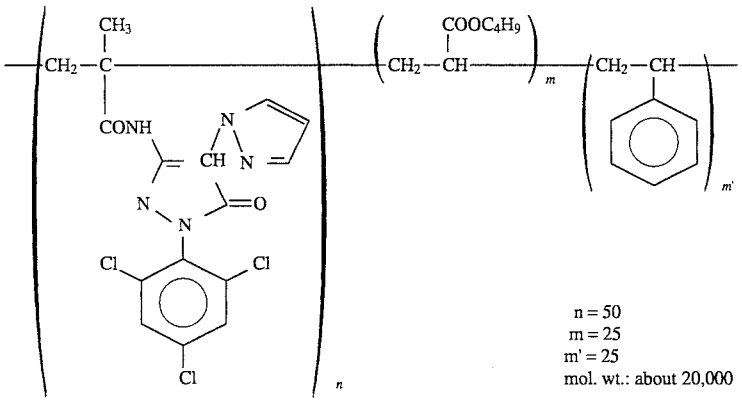
n = 50
m = 25
m' = 25
mol. wt.: about 20,000

-continued
ExM-3
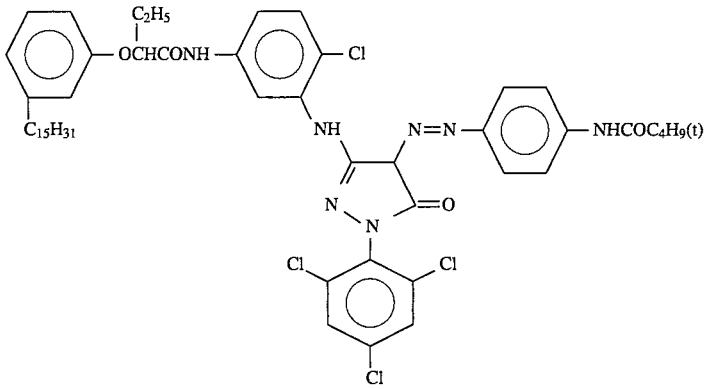
ExM-4
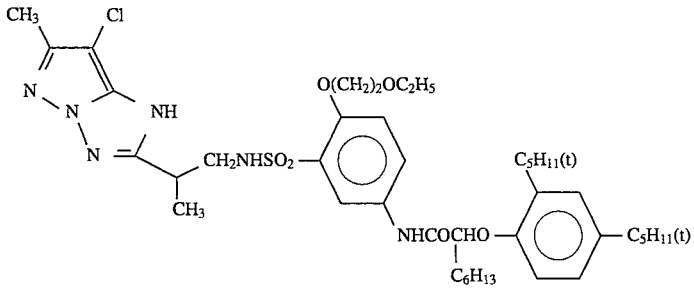
ExM-5
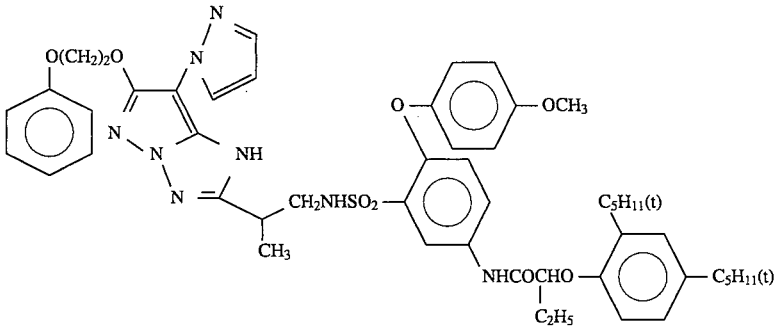
ExY-1
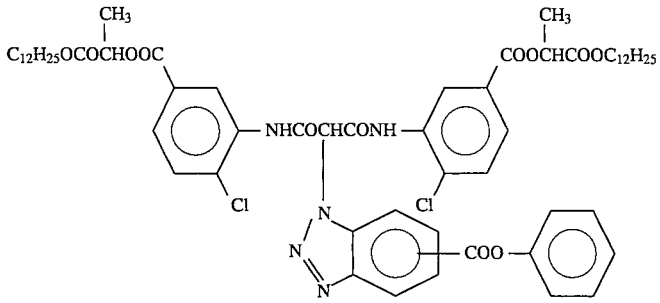
ExY-2
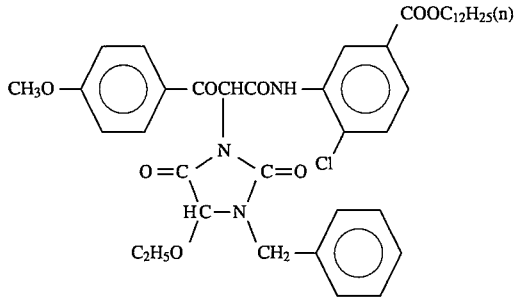

-continued
ExY-3
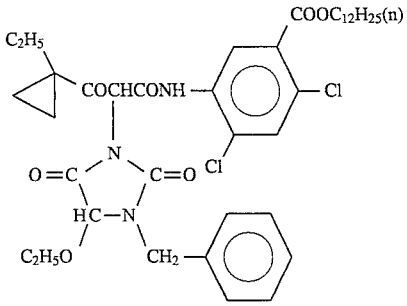
ExY-4
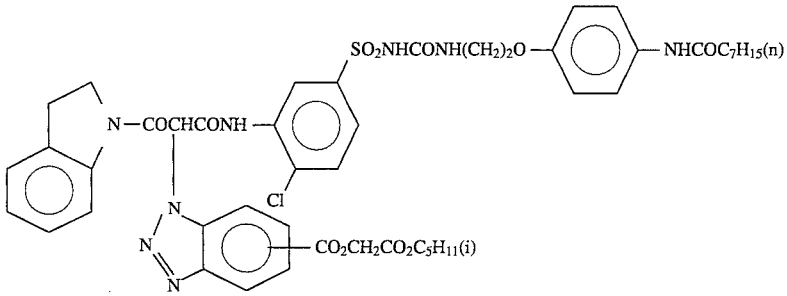
ExF-1
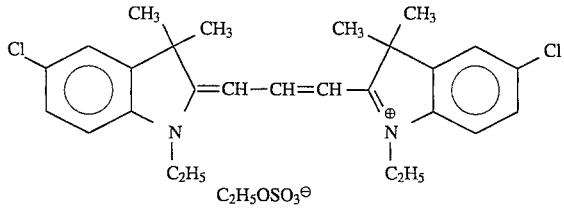
Cpd-1
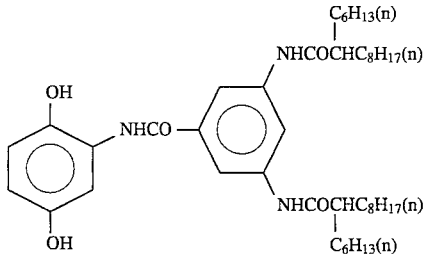
Cpd-2
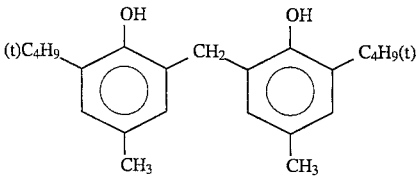
Cpd-3
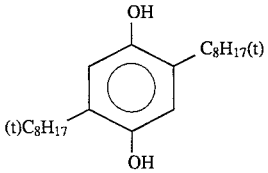
UV-1
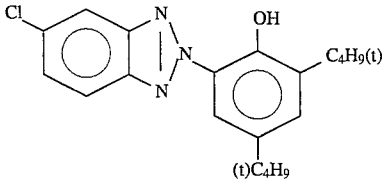

-continued
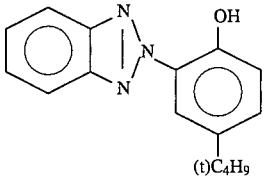
UV-2
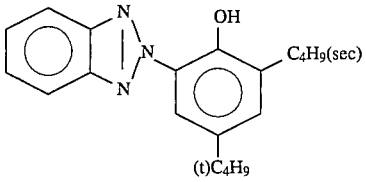
UV-3
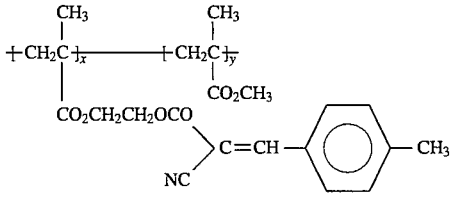
x:y = 70:30 (wt %)
UV-4
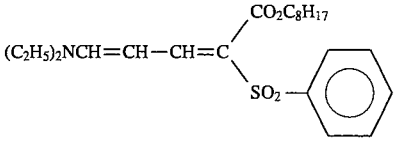
UV-5
Tricresylphosphate HBS-1
Di-n-butylphthalate HBS-2
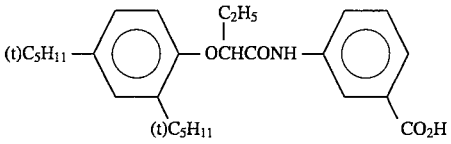
HBS-3
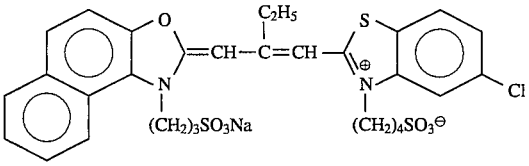
ExS-1
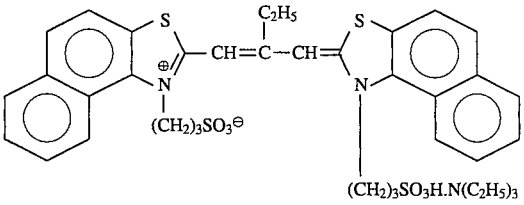
ExS-2
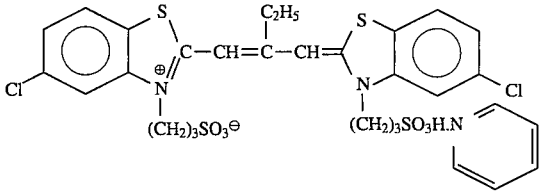
ExS-3

-continued
ExS-4
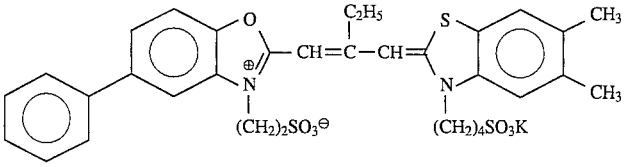
ExS-5
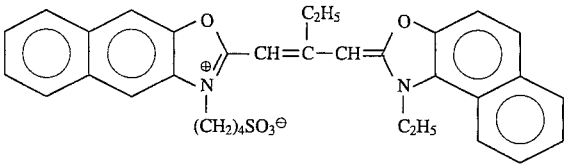
ExS-6
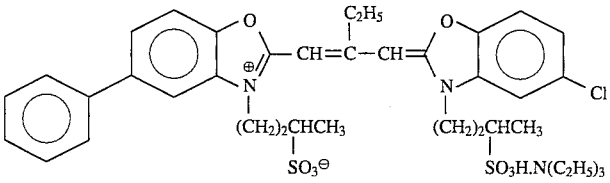
ExS-7
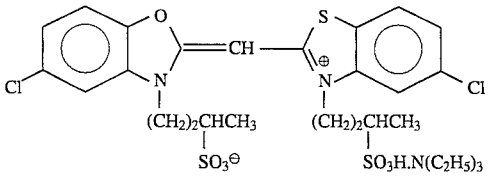
S-1
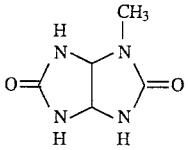
H-1
$CH_2{=}CH{-}SO_2{-}CH_2{-}CONH{-}CH_2$
$CH_2{=}CH{-}SO_2{-}CH_2{-}CONH{-}CH_2$
B-1
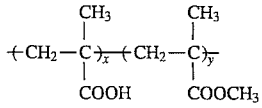
x/y = 10/90
B-2
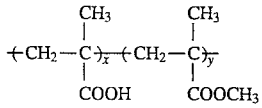
x/y = 40/60
B-3
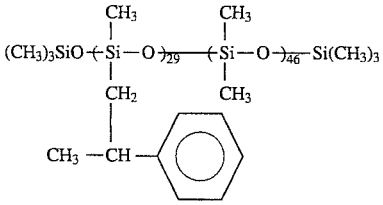
B-4
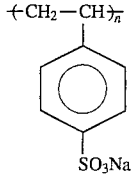

-continued
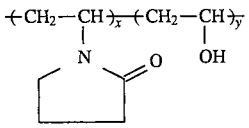
x/y = 70/30 B-5
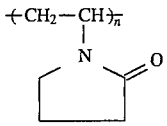
(mol wt.: about 10,000) B-6
$C_8F_{17}SO_2NHCH_2CH_2CH_2OCH_2CH_2\overset{\oplus}{N}(CH_3)_3$
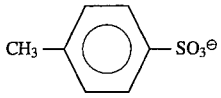
W-1
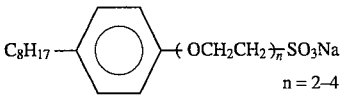
W-2
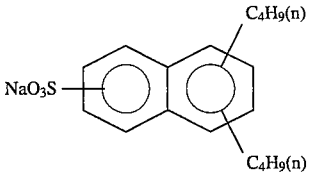
W-3
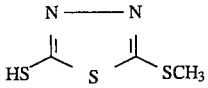
F-1
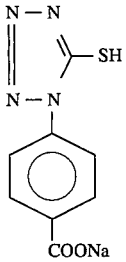
F-2
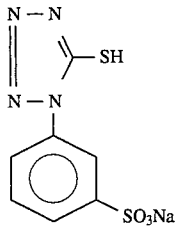
F-3
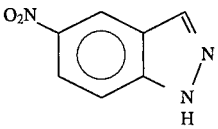
F-4
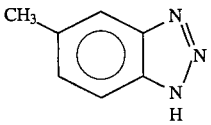
F-5
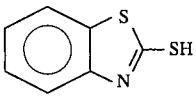
F-6

-continued
F-7
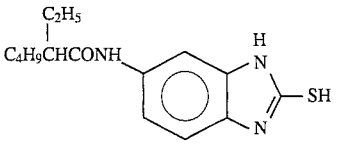
F-8
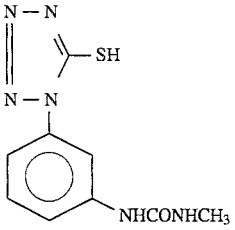
F-9
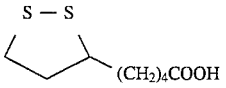
F-10
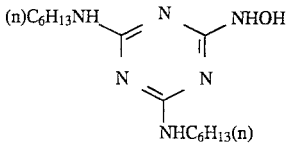
F-11
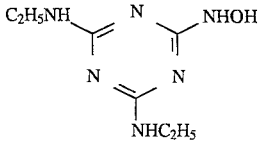
F-12
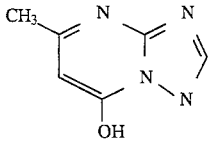
F-13
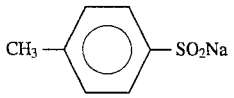
F-14
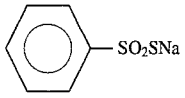
F-15
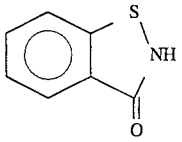
F-16
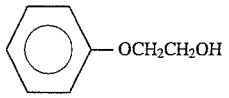
F-17
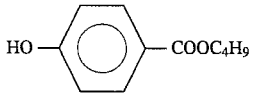
The above color photographic light-sensitive material was exposed to light, and then processed by means of an automatic developing machine under the processing condition specified below (until the accumulated replenishing amount of the developing solution becomes three times as much as the tank capacity thereof).

(Processing Condition)

| Step | Time | Temp. | Replenish Amount* | Tank Vol. |
|---|---|---|---|---|
| Color development | 3 min 15 sec | 38° C. | 22 ml | 20 l |
| Bleaching | 3 min 00 sec | 38° C. | 25 ml | 40 l |
| Water washing (2) | 15 sec | 24° C. | Counter current from tank (2) to tank (1) | 10 l |
| Water washing (3) | 15 sec | 24° C. | 15 ml | 10 l |
| Fixing | 3 min 00 sec | 38° C. | 15 ml | 30 l |
| Water washing (4) | 30 sec | 24° C. | Counter current from tank (4) to tank (3) | 10 l |
| Stabilization | 30 sec | 38° C. | 20 ml | 10 l |
| Drying | 4 min 20 sec | 55° C. | 1200 ml | 10 l |

*Replenish amount per meter of the 35 mm wide light-sensitive material

The compositions of the processing solutions were as follows:

| | Tank Solution (g) | Replenishment Solution (g) |
|---|---|---|
| (Color Developing Solution) | | |
| Diethylenetriamine-pentaacetic acid | 1.0 | 1.2 |
| 1-hydroxyethylidene-1,1-diphosphonic acid | 2.0 | 2.2 |
| Sodium sulfite | 4.0 | 4.8 |
| Potassium carbonate | 30.0 | 39.0 |
| Potassium bromide | 1.4 | 0.3 |
| Potassium iodide | 1.5 mg | — |
| Hydroxylamine sulfate | 2.4 | 3.1 |
| 4-[N-ethyl-N-(β-hydroxyethyl)amino]-2-methylaniline sulfate | 4.5 | 6.0 |
| Water to make | 1.0 liter | 1.0 liter |
| pH (adjusted by potassium hydroxide and sulfuric acid) | 10.05 | 10.15 |
| (Bleaching Solution) | | |
| Sodium Fe (III) ethylenediamine tetraacetate trihydrate | 100.0 | 120.0 |
| Disodium ethylenediamine tetraacetate | 10.0 | 11.0 |
| 3-mercapto-1,2,4-triazol | 0.03 | 0.08 |
| Ammonium bromide | 140.0 | 160.0 |
| Ammonium nitrate | 30.0 | 35.0 |
| Aqueous solution of ammonia (27 wt %) | 6.5 ml | 4.0 ml |
| Water to make | 1.0 liter | 1.0 liter |
| pH (adjusted by an aqueous ammonia solution or nitric acid) | 6.0 | 5.7 |
| (Fixing Solution) | | |
| Disodium ethylenediamine tetraacetate | 0.5 | 0.7 |
| Sodium sulfite | 20.0 | 22.0 |
| Aqueous solution of Ammonium thiosulfate (700 g/l) | 295.0 ml | 320.0 ml |
| Acetic acid (90 wt %) | 3.3 | 4.0 |
| Water to make | 1.0 liter | 1.0 liter |
| pH (adjusted by ammonium and acetic acid) | 6.7 | 6.8 |

-continued

| | Both Tank Solution and Replenishment Solution (g) |
|---|---|
| (Stabilizing Solution) | |
| Sodium p-toluenesulfinate | 0.03 |
| Polyoxyethylene-p-monononylphenyl ether (average polymerization degree: 10) | 0.2 |
| Disodium ethylenediamine tetraacetate | 0.05 |
| 1,2,4-triazole | 1.3 |
| 1,4-bis(1,2,4-triazole-1-ilmethyl)piperazine | 0.75 |
| Water to make | 1.0 liter |
| pH | 8.5 |

It was apparent that the advantages of the present invention could be obtained by replacing the silver bromoiodide emulsion F with emulsion Em-D of the present invention. Further, excellent results were obtained when the emulsion Em-D set forth in Example 3 was used in the high-speed blue-sensitive emulsion layer.

According to the present invention, the distribution of silver iodide content of tabular grains each having a high silver iodide content could be narrowed, and accordingly, an emulsion having a high sensitivity/fog ratio could be prepared.

What is claimed is:

1. A method of preparing a silver halide photographic emulsion comprising tabular grains each having a silver iodide content of 8 to 15 mol %, wherein of said tabular grains those having an aspect ratio of 4 or more occupy 50% or more of a total projected area of all grains present in the emulsion, said method comprising a step of adding, to tabular seed grains, an aqueous silver salt solution containing 1.5 to 5 mol/liter of silver salt and an aqueous halide solution containing 0.01 to 0.075 mol/liter of iodide at a pBr of 0 to 2.3 by means of a double jet method to grow a silver iodide-containing area having a silver iodide content wherein the amount of silver contained in said silver iodide-containing area of each tabular grain comprises 50% or more of the total amount of silver present in said tabular grain and a relative standard deviation of the silver iodide content of said tabular grains is 6% or less.

2. The method according to claim 1, wherein said silver iodide-containing area occupies 60% or more of all silver amount of each of said tabular grains.

* * * * *